US005351397A

United States Patent [19]

Angeli

[11] Patent Number: 5,351,397

[45] Date of Patent: Oct. 4, 1994

[54] METHOD OF FORMING A NUCLEATE BOILING SURFACE BY A ROLL FORMING

[75] Inventor: Daniel J. Angeli, St. Louis, Mo.

[73] Assignee: Olin Corporation, East Alton, Ill.

[21] Appl. No.: 61,759

[22] Filed: May 13, 1993

Related U.S. Application Data

[60] Continuation of Ser. No. 860,656, Mar. 30, 1992, abandoned, which is a division of Ser. No. 448,544, Dec. 11, 1989, Pat. No. 5,062,786.

[30] Foreign Application Priority Data

| | | | |
|---|---|---|---|
| Dec. 12, 1988 | [JP] | Japan | 63-314512 |
| Dec. 16, 1988 | [JP] | Japan | 63-317698 |
| Jul. 4, 1989 | [JP] | Japan | 1-171219 |
| Jul. 7, 1989 | [JP] | Japan | 1-174120 |
| Jul. 10, 1989 | [JP] | Japan | 1-175579 |
| Nov. 20, 1989 | [JP] | Japan | 1-135233 |
| Nov. 20, 1989 | [JP] | Japan | 1-135234 |
| Nov. 20, 1989 | [JP] | Japan | 1-135235 |

[51] Int. Cl.[5] ..... B23P 15/26

[52] U.S. Cl. ..... 29/890.053; 29/890.046; 29/890.049

[58] Field of Search ..... 29/890.045, 890.046, 29/890.049, 890.05

[56] References Cited

U.S. PATENT DOCUMENTS

| | | | |
|---|---|---|---|
| 3,696,861 | 10/1972 | Webb | 165/133 |
| 3,789,915 | 2/1974 | Ford | 165/133 |
| 3,850,227 | 11/1974 | Ford | 165/133 |
| 3,861,462 | 1/1975 | McLain | 165/179 |
| 3,885,622 | 5/1975 | McLain | 165/179 |
| 3,906,605 | 9/1975 | McLain | 29/890.045 |
| 3,991,822 | 11/1976 | Morris | 165/140 |
| 4,050,507 | 9/1977 | Chue et al. | 165/1 |
| 4,059,147 | 11/1977 | Thorne | 165/133 |
| 4,060,125 | 11/1977 | Fujie et al. | 29/890.045 |
| 4,159,739 | 7/1979 | Brothers et al. | 165/133 |
| 4,194,384 | 3/1980 | Fujii et al. | 29/890.05 |
| 4,246,960 | 1/1981 | Poppelwell et al. | 165/134 R |
| 4,275,784 | 6/1981 | Popplewell et al. | 165/134 R |
| 4,353,234 | 10/1982 | Brothers et al. | 29/890.045 |
| 4,474,231 | 10/1984 | Staub et al. | 165/133 |
| 4,523,364 | 6/1985 | Laws et al. | 29/335 |
| 4,561,497 | 12/1985 | Nakajima et al. | 29/890.046 |
| 4,653,163 | 3/1987 | Kuwahara et al. | 29/890.05 |
| 4,660,630 | 4/1987 | Cunningham et al. | 165/133 |
| 4,674,566 | 6/1987 | Heine et al. | 165/134.1 |
| 4,678,029 | 7/1987 | Sasaki et al. | 165/133 |
| 4,692,978 | 9/1987 | Cunningham et al. | 29/890.05 |
| 4,796,693 | 1/1989 | Kastner et al. . | |
| 4,809,415 | 3/1989 | Okayama et al. | 165/133 |
| 4,905,885 | 3/1990 | Hemman, Sr. | 228/144 |
| 5,052,476 | 10/1991 | Sukumoda et al. | 165/133 |
| 5,054,548 | 10/1991 | Zohler | 29/890.05 |
| 5,070,937 | 12/1991 | Mougin et al. | 165/133 |
| 5,184,674 | 2/1993 | Keyes . | |

FOREIGN PATENT DOCUMENTS 2-108411 4/1990 Japan .

OTHER PUBLICATIONS

Shinohara entitled "Development of Various High Efficiency Heat Transfer Cooper Tubing" presented to the International Wrought Copper Council on May 22, 1990 as Paper No. 13, pp. 3–4.

*Primary Examiner*—Irene Cuda

*Attorney, Agent, or Firm*—Gregory S. Rosenblatt

[57] ABSTRACT

A nucleate boiling surface is formed on at least one side of a strip by roll forming. A first pattern of grooves separated by ridges in the form of a double helix is rolled into a strip. A second pattern of more shallow grooves is then machined into the ridges. The ridges are then deformed so that the fin ends extend over the first pattern of grooves forming subsurface channels. Concomitantly, the second pattern of grooves forms a plurality of pores intersecting the subsurface channels.

32 Claims, 6 Drawing Sheets

METHOD OF FORMING A NUCLEATE BOILING SURFACE BY A ROLL FORMING

This application is a continuation of application Ser. No. 07/860,656, filed Mar. 30, 1992, now abandoned, which is a divisional of Ser. No. 07/448,544 now U.S. Pat. No. 5,062,786 filed Dec. 11, 1989.

BACKGROUND OF THE INVENTION

1. Field of the Invention

This invention relates to a method for forming an improved heat exchange surface. More particularly, a nucleate boiling surface is formed on at least one side of a deformable strip by roll forming. The strip can then be formed into a tube having an enhanced nucleate boiling surface.

2. Background of the Invention

In certain refrigeration applications such as a chiller or an evaporator, the liquid to be cooled is passed through a tube while liquid refrigerant is in contact with the outside of the tube. The refrigerant changes state from a liquid to a vapor absorbing heat from the fluid within the tube. The selection of the external configuration of the tube is extremely influential in determining the boiling characteristics and overall heat transfer rate of the tube. As disclosed in U.S. Pat. Nos. 4,050,507 to Chu et al, 4,474,231 to Staub et al. and 5,054,548 to Zoller, the transfer of heat to a boiling liquid is enhanced by the creation of nucleate boiling sites.

In nucleate boiling, liquid adjacent to a trapped vapor bubble is super heated by the heat exchanger surface. Heat is transferred to the bubble at the liquid vapor interface. The bubble grows in size until surface tension forces are overcome by buoyancy and the bubble breaks free from the surface. As the bubble leaves the surface, fresh liquid wets the now vacated area. The remaining vapor absorbs heat from the fresh liquid to form the next bubble. The vaporization of liquid and continuous stripping of the heated liquid adjacent to the heat transfer surface, together with the convection effect due to the agitation of the liquid pool by the bubbles result in an improved heat transfer rate for the heat exchanger surface.

U.S. Pat. No. 5,054,548, as well as U.S. Pat. Nos. 3,696,861 to Webb and 4,653,163 to Kuwahara et al. disclose manufacturing a nucleate boiling surface on the exterior side of a heat exchange pipe. External fin convolutions are formed on the outside surface of a tube using a fin forming disk. The tip portions of fins are bent toward adjacent fins, producing a substantially confined, elongated space which extends around the outside of the tubing forming a plurality of subsurface channels.

The fins are frequently notched prior to being bent over. When the fins are bent over, the fin tips contact the adjacent fin. The notched portion does not contact an adjacent fin and forms a pore intersecting the subsurface channels. During nucleate boiling, a stream of vapor exits through the pores and fresh liquid flows within the subsurface channels to occupy the space vacated by the streaming vapor. The notched fins may be formed by knurling helical notches on the surface of the tube prior to finning.

A method to form a nucleate boiling surface on the inside wall of a heat exchanger pipe is disclosed in U.S. Pat. No. 5,052,476 to Sukumoda et al. A deformable strip of metal is passed through a sequence of forming rolls. The first roll forms a plurality of U-shaped grooves. The undeformed metal separating the U-shaped grooves forms a plurality of fins. A second forming roll forms a V-shaped notch part way through each fin. Flaring the halves of the split fins towards one another brings adjacent split fins in close proximity. The base of the U-shaped groove forms a subsurface channel with the pore an exit means for vapor in accordance with nucleate boiling practice.

Roll forming has been used to enhance either the inside or outside surface of a strip prior to forming into a tube. For example, U.S. Pat. Nos. 3,861,462, 3,885,622 and 3,906,605 all to McLain and all incorporated by reference in their entireties herein, disclose the use of textured rolls to form a desired pattern on either one or both surfaces of a metallic strip. The strip is formed into a tubular shape by passing through a plurality of tube forming rolls. A welding station then joins longitudinally extending edges of the strip to form a complete tube.

Roll forming has been used to form a continuous groove pattern or diamond shaped pattern as disclosed in the McLain patents. A plurality of discrete roughness elements on the internal surface of a tube in the form of flattened pyramids is disclosed in U.S. Pat. No. 5,070,937 to Mougin et al.

Grooves, diamond shaped patterns and roughness elements increase the surface area of the tube and influence the flow of liquid. However, the patterns do not encourage nucleate boiling. Accordingly, it is an object of the present invention to provide a method for forming a nucleate boiling surface by roll forming. It is a feature of the invention that the nucleate boiling surface is formed by a combination of roll forming and machining operations. It is an advantage of the method of the invention that the nucleate surface is formed prior to conversion of the strip into tube and the nucleate surface may be located on either the inside or outside surface. Another advantage of the invention is that both the size of the subsurface channels and the pores are easily controlled. Yet another advantage is that in addition to forming a nucleate surface by roll forming, the opposing side of the strip may be enhanced. Yet another advantage of the invention is that the strip width is limited only by the capacity of the forming rolls. The strip may be slit to a desired width prior to tube forming.

SUMMARY OF THE INVENTION

In accordance with the invention, there is provided a method for forming a nucleate boiling surface on at least one side of a strip. The method includes the steps of (a) roll forming a first pattern of grooves into a first side of the strip. This first pattern of grooves defines a plurality of ridges extending from the strip. The ridges have a base end integral with the strip and an opposing fin end. Step (b) comprises machining a second pattern of grooves into the fin ends. Step (c) comprises deforming the ridges so that the fin ends extend over the first pattern of grooves, forming a plurality of subsurface channels. Concomitant with this deformation, the second pattern of grooves forms a pattern of surface pores which open into the subsurface channels.

The above-stated objects, features and advantages, as well as others, will become more apparent from the specification and drawings which follow. In the drawings, like elements have been given like reference numbers and primed numbers consitute similar elements providing similar functions.

DETAILED DESCRIPTION OF THE INVENTION

Figure 1:
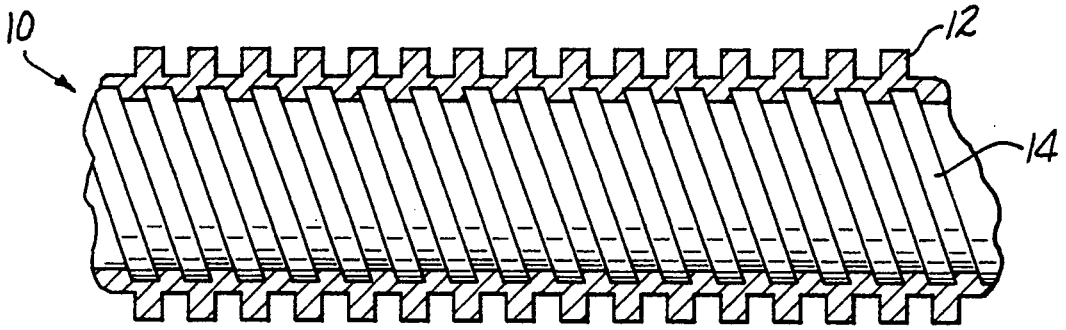
PRIOR ART FIG-1
FIG. 1 shows in cross-sectional representation a heat exchanger tube having enhanced interior and exterior surfaces as known from the prior art.

FIG. 1 shows in cross-sectional representation a heat exchanger tube 10 as known from the prior art. The heat exchanger tube 10 has an external enhancement in the form of fins 12. The fins 12 increase the surface area of the heat exchanger tube 10 in contact with an external heat conducting liquid (not shown). The tube also has internal enhancement in the form of a helical groove 14 to conduct liquid through the tube in a spiral manner increasing the conduction of heat from the liquid inside the tube to the liquid outside the tube.

Figure 2:
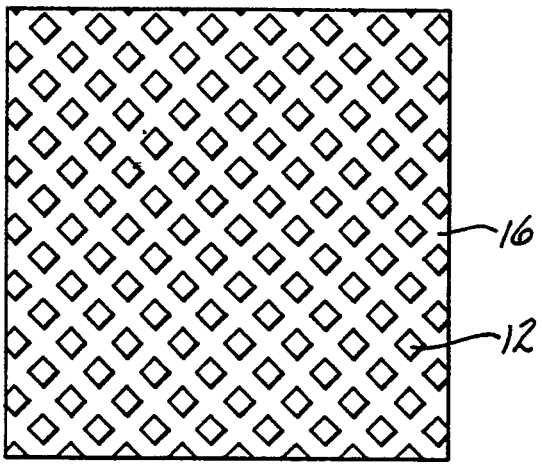
PRIOR ART FIG-2
FIG. 2 shows in top planar representation the exterior surface of the prior art heat exchanger tube illlustrated in FIG. 1.
Figure 3:
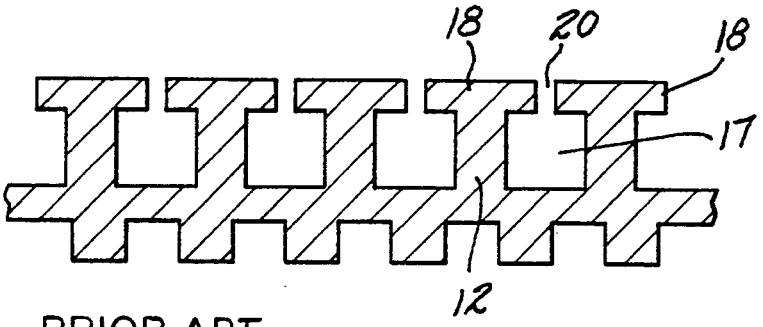
PRIOR ART FIG-3
FIG. 3 shows in cross-sectional representation a portion of the wall of a prior art heat exchanger tube having an enhanced interior surface and an exterior surface suitable for nucleate boiling.

FIG. 2 shows in top planar view the external surface of the heat exchanger tube 10 illustrated in FIG. 1. The fins 12 are separated by grooves 16. The fins 12 may be compressed by a smoothing roller to deform the fin end 18 as illustrated in FIG. 3 and more fully described in U.S. Pat. No. 4,796,693 to Kastner et al. Deformation of the fin end 18 moves each fin end in close proximity to an adjacent fin end with a pore 20 disposed therebetween. The remainder of the groove forms a subsurface channel 17. The structure illustrated in FIG. 3 is ideally suited for nucleate boiling. During heating, a vapor jet exits the pore 20 and heat conducting liquid is replenished through subsurface channel 17.

Figure 4:
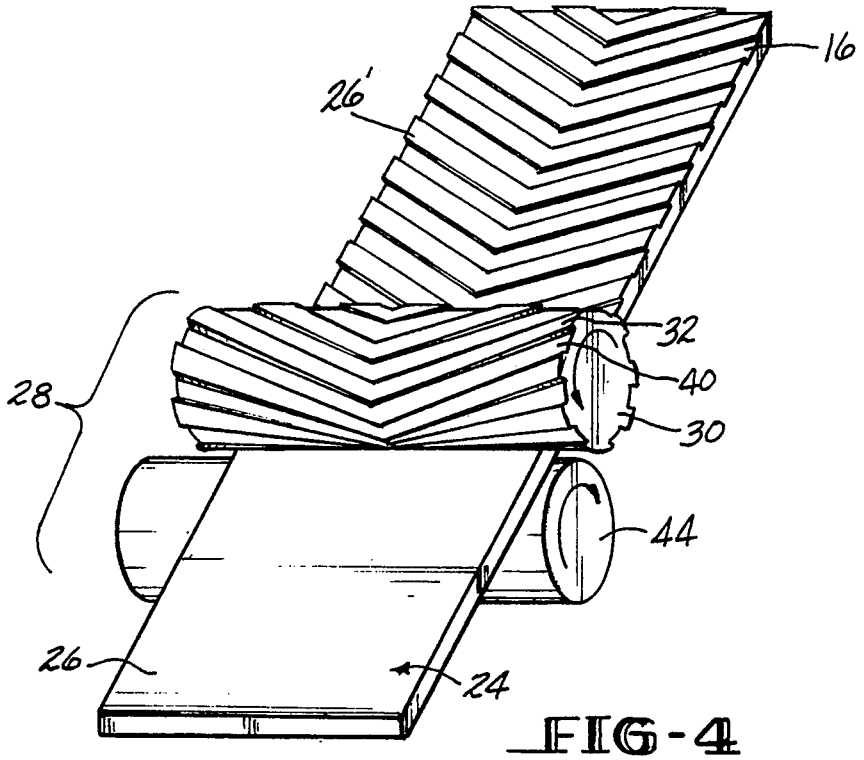
FIG. 4 shows a method for roll forming a first pattern of grooves in a strip in accordance with the invention.

FIG. 4 shows in accordance with the method of the invention a means for roll forming a first pattern of grooves 16 into a first side 24 of a strip 26 of a deformable material. The deformable material may be any suitable for roll forming and use as a heat exhange tube, such as a metal or a polymer. To maximize thermal conductivity, the deformable material is preferably a metal or a metal filled polymer. Most preferred is copper or a copper alloy.

A set of rolls 28 powered by a rolling mill (not known) deforms at least one surface of the strip 26. One roll, preferably the top roll 30, is provided with a desired pattern. Throughout this application, the nomenclature "top roll" designates that roll which contacts the side of the strip 26 which will ultimately form the exterior surface of a tube. The nomenclature "bottom roll" designates that roll which contacts the opposing side of the strip. The actual spatial alignment of the "top" and "bottom" roll is less important than the surface each roll contacts.

The top roll 30 is machined to have a plurality of grooves 32 regularly spaced around the circumference. The grooves may form any desired pattern. A double helix centered about the middle of the long axis of the roll is preferred. The double helix facilitates uniform metal flow through the rolls. Less preferred shapes include grooves extending straight across the roll. With straight grooves, it is difficult to obtain sufficient metal flow without breaking the strip. A single helix provide a large thrust, pushing the strip angularly from the rolls. A double helix provides equal thrust in the direction of both helixes and the strip exits the rolls along substantially the same angle as it entered.

Figure 5:
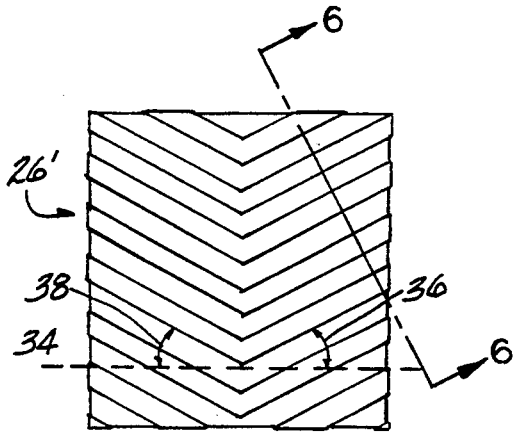
FIG. 5 shows in top planar view a portion of the strip after roll forming the first pattern of grooves.
Figure 6:
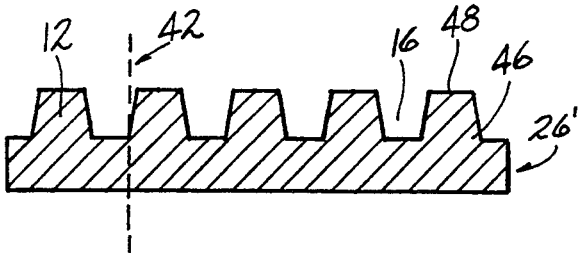
FIG. 6 shows in cross-sectional representation a portion of the strip after roll forming the first pattern of grooves.

FIGS. 5 and 6 illustrate the strip 26' after forming. The angle of the double helix is measured by extending a line 34 along the longitudinal axis of the top roll and measuring the angle at which the grooves 16 extend from this line. The angle 36 may be from about 5° to about 45°. For ease of metal control during roll forming, the angle 36 should be relatively large, on the order of from about 15° to about 30°. For best tube performance, a smaller angle, on the order of about 5° to about 10°, is preferred. Accordingly, for the roll forming step of the invention, an angle 36 of from about 10° to about 20° is most preferred. The angle 38 of the opposing half of the double helix should be equal to the angle 36 so the helixes form a mirror image.

Separating the grooves 32 (FIG. 4) of the top roll 30 are roll teeth 40. As shown in FIG. 6, the roll teeth which form the grooves 16 between fins 12 are tapered. The ends of the roll teeth are slightly smaller than the base of the teeth. The taper should be small, but an angle is necessary so that the roll teeth 40 pierce the strip 26 and separate from the strip without breaking. The roll tooth angle 42 is preferably from about 5° to about 12° and more preferably from about 7° to about 10°.

With reference back to FIG. 4, a change in the thickness of the strip 26, 26' during roll forming is controlled by comparing the speed of the strip 26 prior to roll forming with the speed of the strip 26' after roll forming. The mass entering the rolls equals the mass exiting the rolls. The increase in velocity of the strip 26' is proportional to the reduction in thickness. By measuring speed, the thickness may be accurately controlled.

The bottom roll 44 may be featureless as illustrated in FIG. 4 to serve as a forming anvil for the top roll 30. Alternatively, as described in more detail below, with reference to FIGS. 16–18, the bottom roll 44 may contain features for an enhanced inside tube surface.

With reference to FIG. 6, the first pattern of grooves 16 defines a plurality of ridge-like fins 12 extending from the strip 26'. The ridges are preferably perpendicular to the strip, however, angles other than 90° may be utilized. The ridges 12 have a base end 46 integral with the strip 26'. The opposing end of ridge 12 terminates in a fin end 48. The height of the ridges should be up to about 80% of the overall thickness of the strip 26 prior to roll forming and preferably from about 25% to about 75% of that thickness. Most preferably, the ridges 12 occupy from about 50% to about 60% of the overall thickness of the undeformed strip 26.

Figure 7:
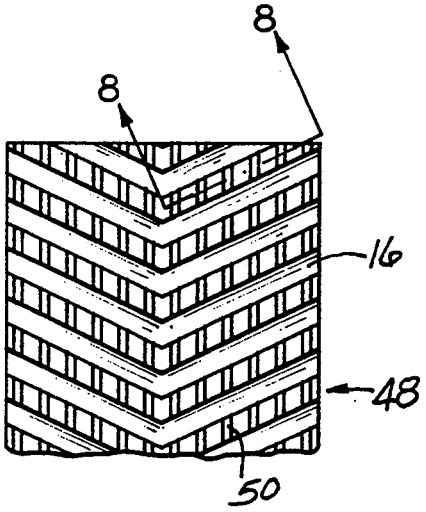
FIG. 7 shows in top planar view a portion of the surface of the strip subsequent to machining a second pattern of grooves into the fin ends.
Figure 8:
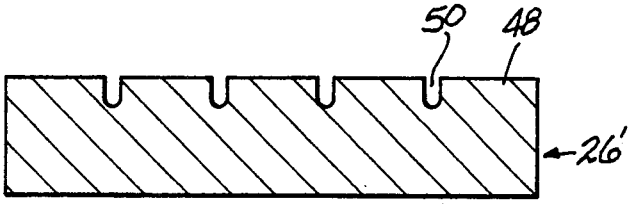
FIG. 8 shows in cross-sectional representation a portion of the strip subsequent to machining a second pattern of grooves into the fin ends.

Following roll forming of the first pattern of grooves which define the plurality of ridges, a second pattern of grooves 50 is machined into the fin ends 48 as illustrated in FIGS. 7 and 8.

Any continuous machining method suitable for long lengths of strip may be used to form the second pattern of grooves 50 in the fin ends 48. Suitable processes include high speed milling and skiving as disclosed in U.S. Pat. No. 4,523,364 to Laws et al which is incorporated by reference in its entirety herein. The second pattern of grooves 50 has a depth less than that of the first pattern of grooves 16. The second pattern of grooves 50 should be from about 10% to about 50% of the depth of the first pattern of grooves 16. More preferably, the second pattern of grooves is from about 20% to about 30% of the depth of the first pattern of grooves 16. As shown in FIG. 7, the second pattern of grooves 50 cuts through the fin ends 48 and intercepts without deforming the first pattern of grooves 16.

The strip 26' containing the first pattern of grooves 16 and second pattern of grooves 50 may be slit to a desired width. To maximize throughput, it is desirable to have the strip as wide as possible for a given set of rolls. However, the overall strip width should be approximately equal to a multiple of the width of strip required for a desired circumference of tube to minimize waste. The strip can be slit to a desired width either at this step or after formation of the nucleate boiling surface.

Figure 9:
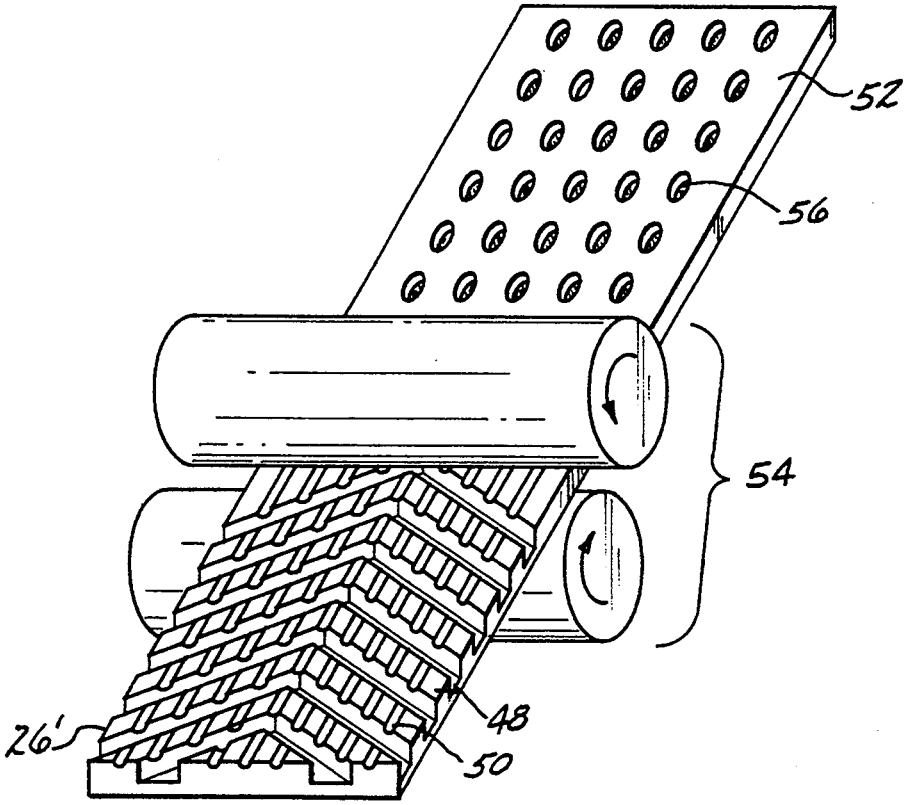
FIG. 9 illustrates a method for deforming the ridges so that the fin ends extend over the first pattern of grooves forming subsurface channels and concomitantly the second pattern of grooves forms a plurality of pores intersecting the channels.
Figure 10:
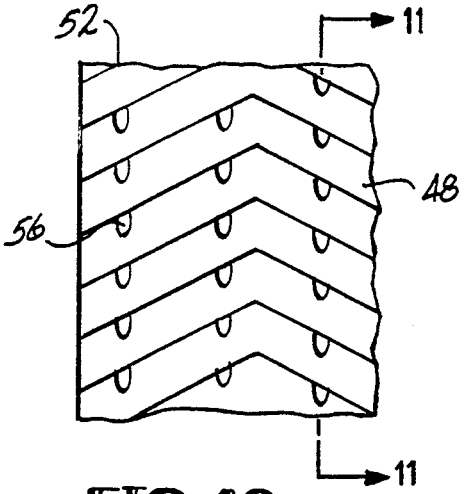
FIG. 10 illustrates in top planar view a surface of the strip after deforming the ridges to form a plurality of subsurface channels and concomitantly pores intersecting the channels.
Figure 11:
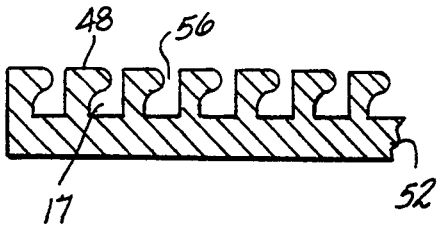
FIG. 11 shows in cross-sectional representation a portion of the strip after deforming the ridges to form a plurality of subsurface channels and concomitantly pores intersecting the channels.

FIG. 9 shows a method for forming a nucleate boiling surface 52. When the patterned strip 26' passes through smoothing rolls 54, fin ends 48 are crushed and deform contacting adjacent fin ends. Where the second pattern of grooves 50 cuts through the fin ends 48, less metal is available and a pore 56 is formed. The nucleated boiling surface 52 is shown in top planar view in FIG. 10 and in cross section in FIG. 11. Fin ends 48 have been substantially closed at the surface except for the pores 56. The resultant structure when viewed in cross section has a plurality of subsurface channels 17 substantially covered by collapsed fin ends 48 except for pores 56. This structure is ideally suited for nucleated boiling.

Figure 12:
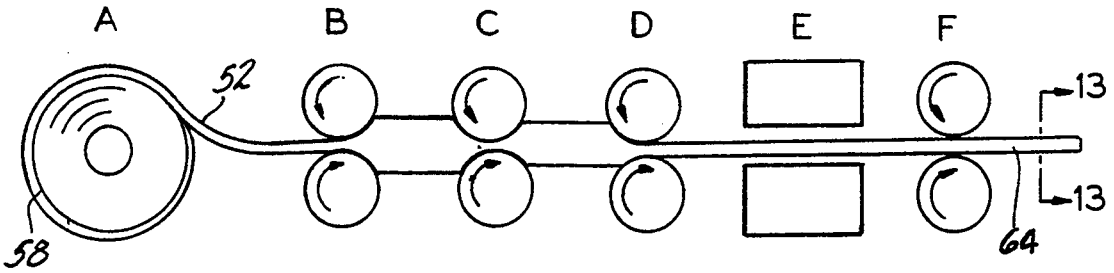
FIG. 12 shows a diagramatic view of the method for converting strip to tube.

The nucleate boiling surface is now complete. Typically, the strip is next formed into a welded tube. Forming thin wall tubing from metallic strip is disclosed in U.S. Pat. No. 4,905,885 to Hellman, Sr., which is incorporated by reference in its entirety herein. The process is shown generally in FIGS. 12 and 13A–13F. FIG. 12 illustrates the various stations employed in forming a welded thin wall tube. FIGS. 13A–13F illustrate in cross-sectional representation the approximate shape of the strip at each step of the tube forming process.

Figure 13A:
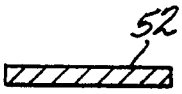
FIGS. 13A–13F illustrate in cross-sectional representation the shape of the strip during each operation in the strip to tube process.
Figure 13B:
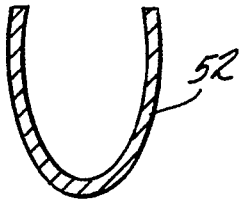
Figure 13C:
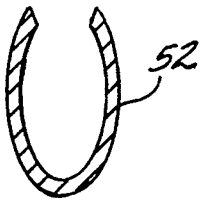
Figure 13D:
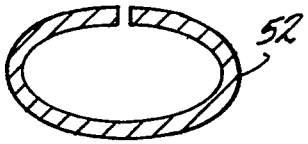
Figure 13E:
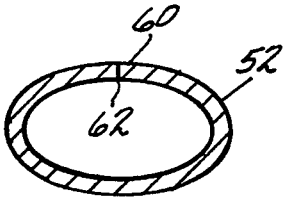
Figure 13F:
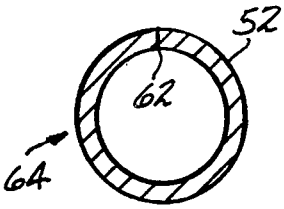

A coil of metal strip 58 is located at station "A" and illustrated in cross-sectional representation in FIG. 13A. The strip of metal 58 has one side 52 formed into a nucleate boiling surface as described above. The metal strip 58 enters a series of forming rolls (B,C and D) which converts the flat strip into an oval shape with the longitudinal edges 60 of the strip brought into close proximity as illustrated in FIGS. 13B–13D. A welding station (E) bonds the longitudinal edges 60 of the metallic strip together at a weld seam 62. Any suitable method of welding, including a torch or high frequency induction welding may be utilized. Subsequent to welding, the strip continues through an additional set of forming rolls (F) to obtain the substantially round cross section illustrated in FIG. 13F. The nucleated boiling surface 52 forms the exterior surface of the welded tube 64.

Figure 14:
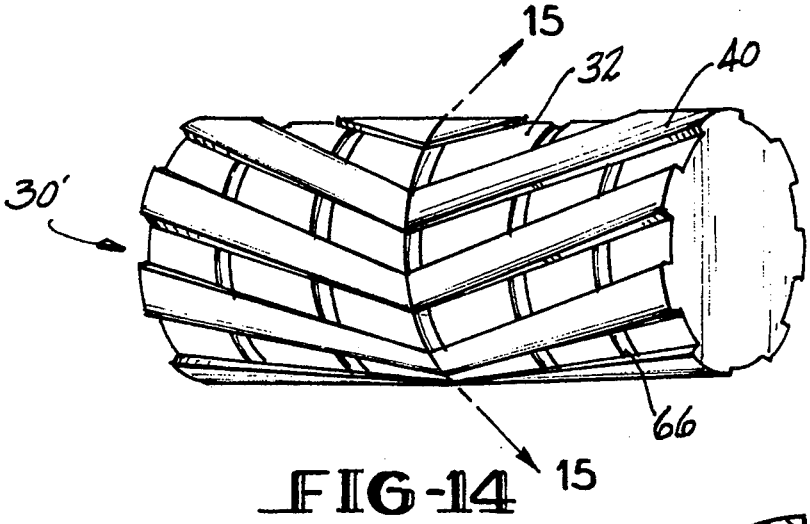
FIG. 14 illustrates a forming roll in accordance with an embodiment in which the second pattern of grooves is formed by roll forming.
Figure 15:
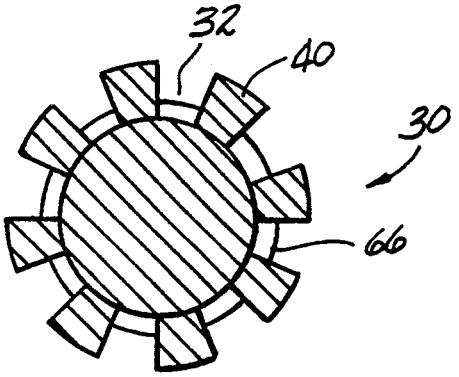
FIG. 15 shows in cross-sectional representation the forming roll of FIG. 14.
Figure 16:
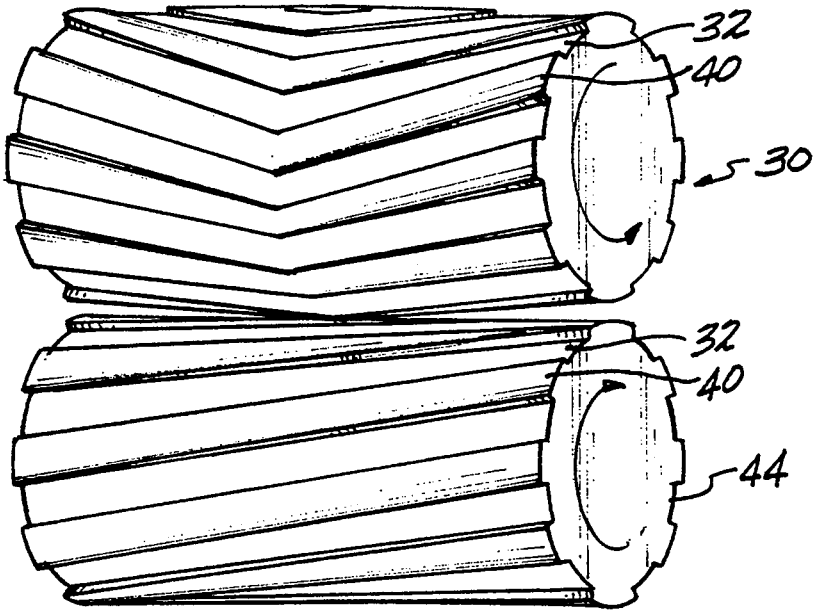
FIG. 16 shows a set of forming rolls for forming a nucleated surface on one side of a strip and an enhanced surface on the opposite side.

In an alternative embodiment of the invention, the machining step to form the second pattern of grooves may be eliminated by a unique design of the top roll as illustrated in FIGS. 14 and 15. The top roll 30' in addition to containing a plurality of grooves 32 separating a plurality of roll teeth 40 contains cross ridges 66. The cross ridges may be any shape suitable for piercing a strip such as a pyramid having either a flat or knife edge exterior surface. A knife edge surface gives improved piercing and movement of the metal strip. As illustrated in FIG. 15 which is a cross-sectional representation of the top roll 30' illustrated in FIG. 14, the cross ridges 66 are located at the base of the grooves 32. The grooves 32 correspond to the ridges formed in the deformable strip while roll teeth 40 form the first pattern of grooves. With the formation of the first pattern of grooves by roll teeth 40, cross ridges 66 form a pattern of cross grooves intersecting the ridges. The necessity for a separate machining step is avoided. The strip may proceed directly to the flattening step illustrated in FIG. 9 for formation of a nucleated boiling surface. Roll forming is not limited to the top roll. As illustrated in FIG. 16, both the top roll 30 and the bottom roll 44 may be patterned. While both the top roll 30 and bottom roll 44 may have a double helix pattern, it is not necessary for the top and bottom rolls to have identical patterns. The enhancement desired for the inside surface of the welded tube formed by the bottom roll 44, may be different than that required of the external surface. To maximize the contact of fluid with the inside walls of the tube, the formation of a spiral helix is achieved using a helical pattern as illustrated in FIG. 16. The helical pattern comprises alternating grooves 32 and roll teeth 40 in a single helix formed on bottom roll 44.

If control of metal thrust is a problem with the single helix, the bottom roll 44 may be formed as a double helix and subsequently slit along the center line prior to tube forming.

Figure 17:
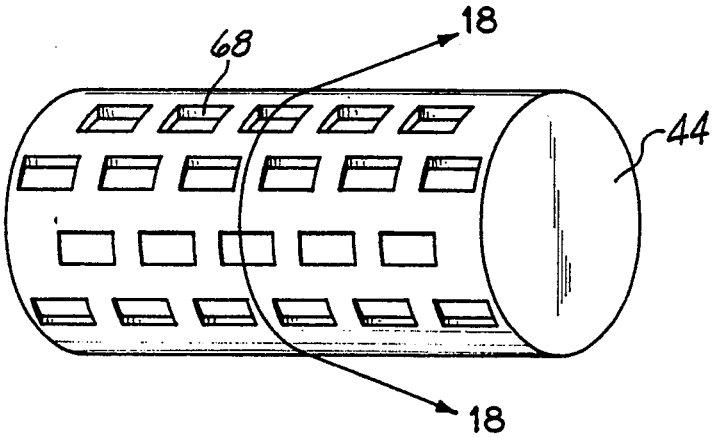
FIG. 17 shows a roll for forming a plurality of pyramid shaped roughness elements on one side of a strip.
Figure 18:
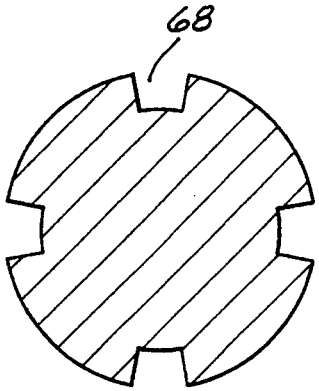
FIG. 18 shows in cross-sectional representation the roll of FIG. 17.
Figure 19:
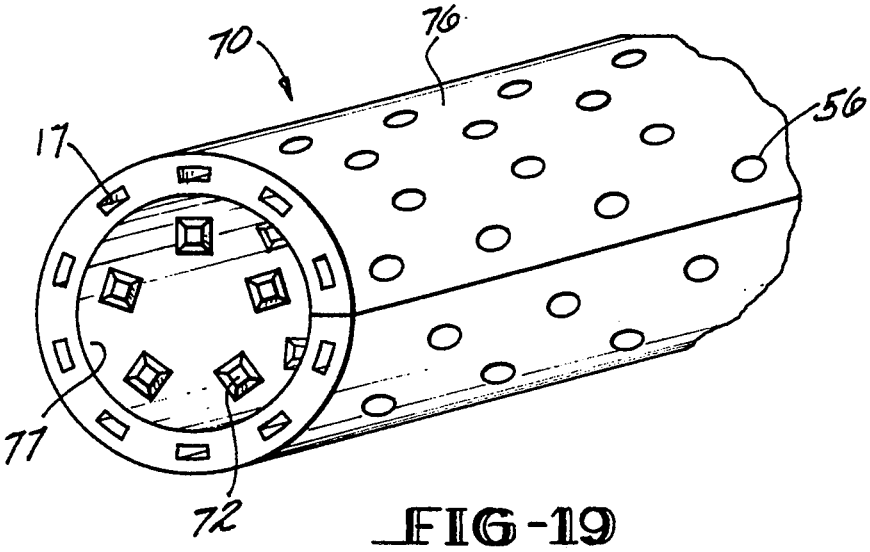
FIG. 19 illustrates a heat exchanger pipe having a plurality of pyramid shaped roughness elements on the inside wall and a nucleated boiling surface on the outside wall.

Another roll fromed internal enhancement is internal roughness elements such as flattened pyramids as disclosed in U.S. Pat. No. 5,070,937. FIGS. 17 and 18 illustrate a bottom roll 44 for producing a roughness element. Bottom roll 44 contains a plurality of discrete recesses 68 having a desired taper. The top roll (not shown) is preferably in the form of a double helix. As illustrated in cross section in FIG. 18, the recessed structure 68 is slightly tapered to minimize breakage of either the strip or the roll features. After roll forming and forming the top side into a nucleated boiling surface, the strip is formed into a welded tube 70 as illustrated in FIG. 19. The inside surface of the tube contains a plurality of roughness elements 72 to create turbulent liquid flow. The outside surface 76 of the tube contains a plurality of pores 56 interconnected to subsurface channels 17 for nucleate boiling to maximize the transfer of heat from the outside surface 76 of the tube.

While the method of the invention has been particularly described in connection with welded tube, the roll formed strip may be utilized in any heat exchanger application and may take a configuration other than tube such as a rectangle or other geometric form.

The patents set forth in this application are intended to be incorporated by reference herein.

It is apparent that there has been provided in accordance with this invention a method for forming a nucleate boiling surface on at least one side of a deformable strip which fully satisfies the objects, means and advantages set forth hereinabove. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A method for forming a nucleate boiling surface on one side of a strip and an enhanced surface pattern on the opposite side, comprising:

(a) roll forming a first pattern of grooves into a first side of said strip and an internal enhancement into the opposing side of said strip, said first pattern of grooves defining a plurality of ridges extending substantially from said strip, said ridges having a base end integral with said strip and an opposing fin end;

(b) machining a second pattern of grooves into said fin ends to a depth of from about 10% to about 50% of the depth of said first pattern of grooves; and (c) deforming said ridges so said fin ends extend over said first pattern of grooves forming a plurality of subsurface channels, concomitantly said second pattern of grooves forming a pattern of surface pores opening into said subsurface channels.

2. The method of claim 1 wherein said internal enhancement is roll formed to a helix.

3. The method of claim 1 wherein said internal enhancement is roll formed to discrete roughness elements.

4. The method of claim 1 wherein said roll forming step includes embossing said first pattern of grooves in a double helix configuration with an angle of from about 5° to about 45°.

5. The method of claim 4 wherein said embossed angle is from about 10° to about 20°.

6. The method of claim 5 wherein said cross grooves are roll formed to a conical shape.

7. The method of claim 4 wherein said second pattern of grooves is machined to a depth of from about 20% to about 30% of the depth of said first pattern of grooves.

8. The method of claim 4 wherein said machining step comprises in-line milling.

9. The method of claim 8 including the additional step (d) of forming said strip into a welded tube.

10. A method for forming a nucleate boiling surface on one side of a strip and an enhanced surface pattern on the opposite side, comprising:

(a) in a single pass, roll forming the combination of a first pattern of grooves and cross grooves into a first side of said strip as well as an internal enhancement into the opposing side of said strip, said first pattern of grooves defining a plurality of ridges extending substantially from said strip, said ridges having a base end integral with said strip and an opposing fin end, said cross grooves intercepting said ridges at intervals along said fin end; and (b) deforming said ridges so said fin ends extend over said first pattern of grooves forming a plurality of subsurface channels, concomitantly said cross grooves forming a pattern of surface pores opening into said subsurface channels.

11. The method of claim 10 wherein said internal enhancement is roll formed to a helix.

12. The method of claim 10 wherein said internal enhancement is roll formed to discrete roughness elements.

13. The method of claim 10 wherein said roll forming step includes embossing said first pattern of grooves in a double helix configuration with an angle of from about 5° to about 45°.

14. The method of claim 13 wherein said embossed angle is from about 10° to about 20°.

15. The method of claim 13 wherein said cross grooves are roll formed to a depth of from about 10% to about 50% of the depth of said first pattern of grooves.

16. The method of claim 15 wherein said cross grooves are roll formed to a depth of from about 20% of about 30% of the depth of said first pattern of grooves.

17. The method of claim 6 including the additional step (d) of forming said strip into a welded tube.

18. A method for forming a nucleate boiling surface on at least one side of a strip, comprising:

(a) roll forming a first pattern of grooves into a first side of said strip, said first pattern of grooves defining a plurality of ridges extending from said strip, said ridges having a base end integral with said strip and an opposing fin end;

(b) machining a second pattern of grooves into said fin ends to a depth of from about 10% to about 50% of the depth of said first pattern of grooves; and (c) deforming said ridges so said fin ends extend over said first pattern of grooves forming a plurality of subsurface channels, concomitantly said second pattern of grooves forming a pattern of surface pores opening into said subsurface channels.

19. The method of claim 18 wherein said roll forming step includes embossing said first pattern of grooves in a double helix configuration with an angle of from about 5° to about 45°.

20. The method of claim 19 wherein said embossed angle is from about 10° to about 20°.

21. The method of claim 19 wherein embossing said first pattern of grooves defining the height of said plurality of ridges as up to about 80% of the thickness of the strip prior to roll forming.

22. The method of claim 21 wherein embossing said first pattern of grooves defines the height of said plurality of ridges as from about 25% to about 75% of the thickness of said strip prior to roll forming.

23. The method of claim 21 wherein said second pattern of grooves is machined to a depth of from about 20% to about 30% of the depth of said first pattern of grooves.

24. The method of claim 21 wherein said machining step comprises in-line milling.

25. The method of claim 24 including the additional step (d) of forming said strip into a welded tube.

26. A method for forming a nucleate boiling surface on at least one side of a strip, comprising:

(a) in a single pass, roll forming both a first pattern of grooves and cross grooves into a first side of said strip, said first pattern of grooves defining a plurality of ridges extending substantially from said strip, said ridges having a base end integral with said strip and an opposing fin end, said cross grooves intercepting said ridges at intervals along said fin end; and (b) deforming said ridges so said fin ends extend over said first pattern of grooves forming a plurality of subsurface channels, concomitantly said cross grooves forming a pattern of surface pores opening into said subsurface channels.

27. The method of claim 26 wherein said roll forming step includes embossing said first pattern of grooves in a double helix configuration with an angle of from about 5° to about 45°.

28. The method of claim 27 wherein said embossed angle is from about 10° to about 20°.

29. The method of claim 27 wherein said cross grooves are roll formed to a depth of from about 10° to about 50° of the depth of said first pattern of grooves.

30. The method of claim 29 wherein said cross grooves are roll formed to a depth of from about 20% to about 30% of the depth of said first pattern of grooves.

31. The method of claim 29 wherein said cross grooves are roll formed with a knife edge base.

32. The method of claim 31 including the additional step (d) of forming said strip into a welded tube.

* * * * *

UNITED STATES PATENT AND TRADEMARK OFFICE

CERTIFICATE OF CORRECTION

PATENT NO. : 5,351,397
DATED : October 4, 1994
INVENTOR(S) : Angeli

It is certified that error appears in the above-indentified patent and that said Letters Patent is hereby corrected as shown below:

TITLE PAGE

Item [54] and column 1, line 3, delete "A" (second occurrence).

Item [60] Related U.S. Application Data, everything after "abandoned" should be deleted.

Item [30] Foreign Application Priority Data, everything should be deleted.

Signed and Sealed this

Seventeenth Day of January, 1995

*Attest:*

*Attesting Officer*

BRUCE LEHMAN

*Commissioner of Patents and Trademarks*